United States Patent [19]

Cote

[11] 4,211,143

[45] Jul. 8, 1980

[54] MUSICAL INSTRUMENT

[76] Inventor: Robert J. Cote, 9692 E. Outer Dr., Detroit, Mich. 48213

[21] Appl. No.: 30,105

[22] Filed: Apr. 16, 1979

[51] Int. Cl.[3] ..... G10D 13/08

[52] U.S. Cl. ..... 84/402; 84/408; 84/421

[58] Field of Search ..... 84/402, 408, 421, 422

[56] References Cited

U.S. PATENT DOCUMENTS

| | | | |
|---|---|---|---|
| 590,182 | 9/1897 | Bower | 84/422 |
| 624,662 | 5/1899 | Leedy | 84/421 |
| 1,453,968 | 5/1923 | Bartholomae | 84/402 |
| 1,671,882 | 5/1928 | Bartholomae | 84/402 |
| 2,510,957 | 6/1950 | Carter | 84/402 |
| 2,687,059 | 8/1954 | Doyle | 84/402 |
| 3,167,995 | 2/1965 | La Londe | 84/421 |

FOREIGN PATENT DOCUMENTS

| | | | |
|---|---|---|---|
| 596962 | 11/1925 | France | 84/408 |

*Primary Examiner*—Lawrence R. Franklin
*Attorney, Agent, or Firm*—Adolph G. Martin

[57] ABSTRACT

A musical instrument having an adjustable elongated member supported in an upright position on a collapsible base. A flat flexible sheet of metal, or other suitable materials capable of producing a musical tone when struck, is adjustably mounted on the upper end of the elongated member. An operator lever, pivotally mounted on the collapsable base, is connected to the flat flexible sheet by a cable. An actuator pedal on the operator lever enables it to be conveniently manipulated so as to selectively flex the flat flexible sheet when it is being struck by a percussive implement thereby producing variations in tone. A further variation in tone can be achieved by drawing a conventional violin bow across the edge of the flat flexible sheet as it is being flexed.

8 Claims, 7 Drawing Figures

MUSICAL INSTRUMENT

BACKGROUND OF THE INVENTION

This invention relates to musical instruments generally, but more particularly to percussion instruments. The applicant's instrument is also related to those stringed instruments which are adapted for use in conjunction with a bow, such as the violin, viola and cello. Certain of the percussion instruments, such as the drum and cymbal, admit of little if any variations in tone.

For this reason their role in musical aggregations is limited almost exclusively to providing the beat, rhythm and background for the lead instruments. Fully cognizant of this limitation for these musical instruments, the applicants has developed a unique and versatile percussion type of instrument which can be manipulated and utilized to provide a range of extremely interesting and pleasant variations in tone.

SUMMARY OF THE INVENTION

This invention consists of an upright elongated adjustable member 10 attached to a collapsable base 22. A flat flexible sheet 62, of metal or other suitable material, is adjustably mounted on the upper end of the upright elongated member 10. An operator lever 70, having thereon an actuator foot pedal 72, is pivotally attached to the collapsable base 22. A flexible cable 74 is connected between the operator lever 70 and the flat flexible sheet 62.

CONSTRUCTION

Figure 1:
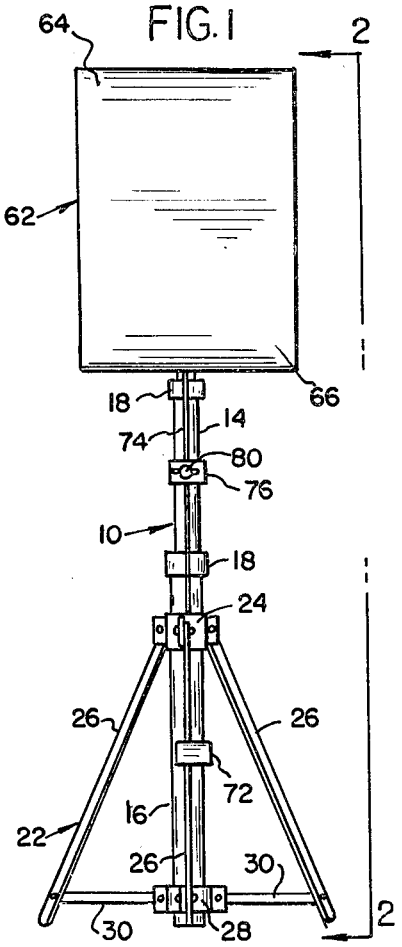
FIG. 1 is a front elevation view of the device constituting the applicant's invention.

For a more detailed description of the invention, reference is made to the drawings in which numeral 10 designates an elongated tubular member having three telescoping segments 12,14 and 16. Collars 18, on the upper ends of telescoping segments 14 and 16, each has threaded therein a locking screw 20. A collapsable base 22, on the elongated tubular member 10, has a fixed collar 24 adjacent the upper end of telescoping segment 16.

Three spaced downwardly disposed legs 26 are pivotally mounted on the fixed collar 24. A slidable collar 28 is provided on the lower portion of the telescoping segment 16. Three spaced lateral supports 30 are pivotally connected between the slidable collar 28 and the downwardly disposed legs 26. A housing 32, comprising two sections 34 and 36, is mounted on the upper end of the telescoping segment 12.

Figure 6:
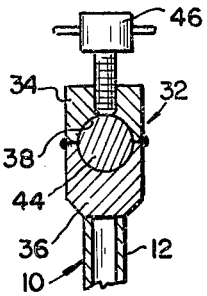
FIG. 6 is an enlarged section view, taken substantially on plane 6—6 in FIG. 2, showing the locking screw 46 in the upper section 34 of the housing 32.
Figure 7:
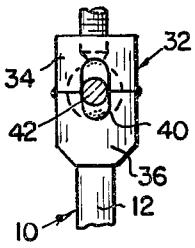
FIG. 7 is an enlarged fragmentary section view, taken substantially on plane 7—7 in FIG. 2, showing the vertically disposed slot 40 in the housing 32.
Figure 5:
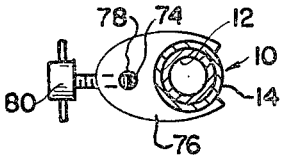
FIG. 5 is an enlarged section view, taken substantially on plane 5—5 in FIG. 2, showing structural details of the cable guide 76 on the elongated tubular member 10.

The two sections 34 and 36 are welded together, or otherwise suitably connected, as shown in FIGS. 6 and 7. A spherical socket 38, and a vertically disposed slot 40 are provided in the housing 32. A mounting bolt 42 has on one end thereof, a ball slidably seated in the socket 38 of the housing 32. A locking screw 46, threaded into the upper section 34 of the housing 32, is adapted to holdably engage the ball 44 on the mounting bolt 42.

The mounting bolt 42, is threaded on the outer end, and has a seating disc 50 integral therewith covered by a felt washer 52. An elongated channel member 54, is centrally supported on the mounting bolt 42, and in bearing engagement with the felt washer 52 covering the seating disc 50. Another felt washer 56 is held in bearing engagement with the opposite side of the elongated channel member 54 by a metal washer 58 and a nut 60 engaged on the threaded end of the mounting bolt 42.

A substantially flat flexible sheet 62 of metal, or other suitable material capable of producing a musical tone when struck, has inwardly curved end sections 64 and 66. One of the curved end sections 64 on the flat flexible sheet 62 is secured in the elongated channel member 54 by spaced rivets 68. An operator lever 70 is pivotally attached at one end to a downwardly disposed leg 26 on the collapsable base 22.

An actuator foot pedal 72 is mounted on the outer end of the operator lever 70. A flexible cable 74 is connected between the inwardly curved end section 66 on the flat flexible sheet 62 and the operator lever 70. A cable guide 76, adjustably mounted on segment 14 of the elongated tubular member 10, has therein an eye 78 through which the flexible cable 74 is passed. A locking screw 80 on the cable guide 76 is adapted to holdably engage the flexible cable 74 passing therethrough so as to retain the flat flexible sheet 62 in any desired position.

The preceding discussion completes a description of the structural details of the single embodiment of the applicant's invention herein disclosed. However, to facilitate a more thorough understanding of the subject matter herein presented, a discussion of the manner in which the device is used and operates to fulfill its intended function is immediately hereinafter set forth.

Figure 2:
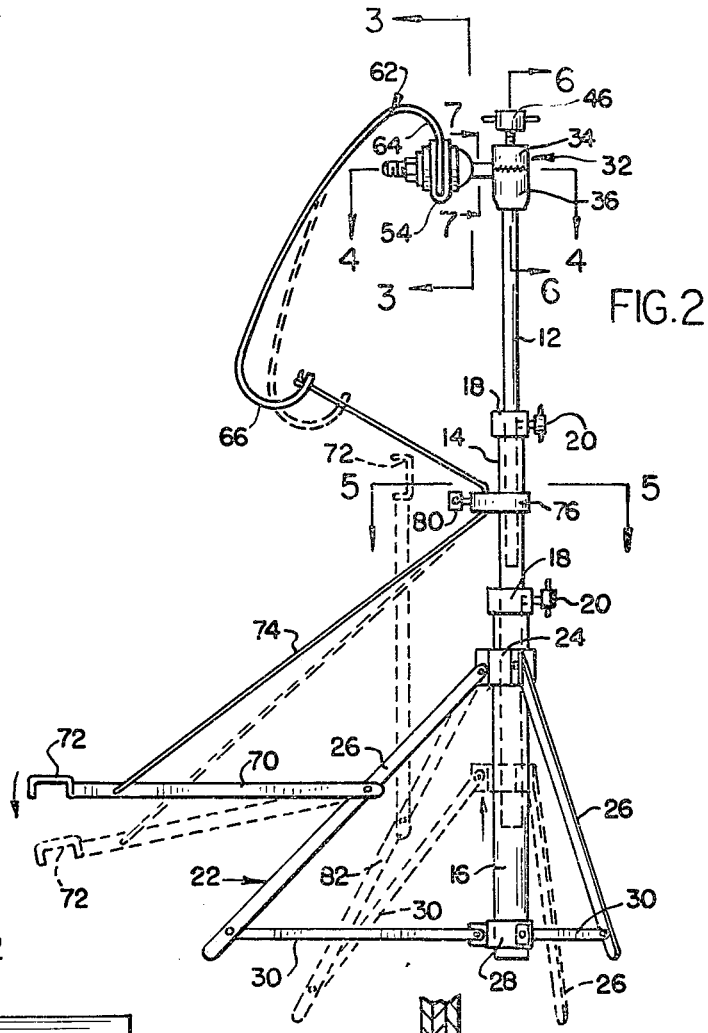
FIG. 2 is a side elevation view, taken substantially on plane 2—2 in FIG. 1, showing structural details of the device.
Figure 3:
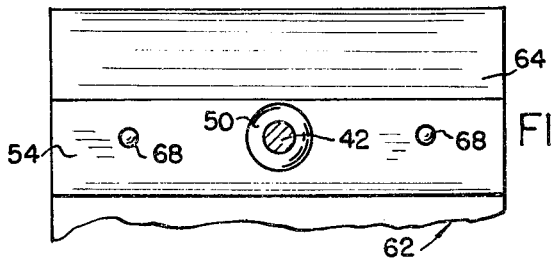
FIG. 3 is an enlarged fragmentary section view, taken substantially on plane 3—3 in FIG. 2, showing the 'U' shaped support 54 on the flat flexible sheet 62.
Figure 4:
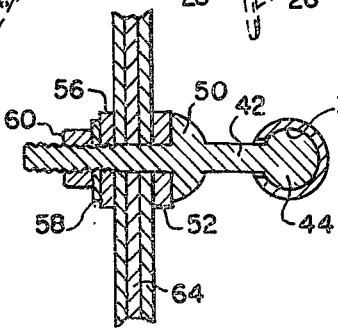
FIG. 4 is an enlarged fragmentary section view, taken substantially on plane 4—4 in FIG. 2, showing structural details of the mounting bolt 42 and its associated components.

In use the collapsed base 22, shown by the broken lines 82 in FIG. 2, is expanded so as to place the downwardly disposed legs 26 in the full line position shown. The two locking screws 20 in the collars 18 on the telescoping segments 14 and 16 are then loosened, and the elongated tubular member 10 adjusted so as to place the flat flexible sheet 62 at the desired height. The locking screws 20 are re-tightened, and the flat flexible sheet 62 placed in the desired attitude by means of the ball 4 and socket 38 support for the mounting bolt 42 in the housing 32 at the upper end of the elongated member 10.

The operator lever 70 may then be manipulated by the actuator foot pedal 72 to flex the flat flexible sheet 62, as shown by the broken lines in FIG. 2, so that it will produce the desired sound when struck by mallets, sticks or other suitable percussive implements not here shown. In practice, a conventional violin or cello bow may be substituted for the mallets or sticks. The bow is used by drawing it across the edge of the flat flexible sheet 62 as it is being selectively flexed, thereby producing a distinctive and extremely pleasant variation in sound.

Based upon the foregoing discussion, the applicant is of the opinion that his invention has fulfilled a long-felt need in the field of musical instruments, and that he has accordingly made a valuable contribution to the related art. However, while the invention has been described with reference to the structural details of only a single embodiment, it will be appreciated by those familiar with the art that the principles involved are susceptible of numerous other practical adaptations.

I therefore claim as new, and desire to secure by Letters Patent:

1. A musical instrument comprising an elongated member, a base on one end of the elongated member holding it in an upright position, a flat flexible member, connecting means attaching the flat flexible member to the upper end of the elongated member, an operator lever pivotally connected to the base, and an elongated flexible member connecting the operator lever to the flat flexible member so that the latter said member can be selectively flexed to produce different tones when it is struck.

2. The musical instrument of claim 1 having in addition thereto a foot actuator pedal on the operator lever.

3. The musical instrument of claim 2 in which the elongated member has a plurality of telescoping segments.

4. The musical instrument of claim 3 having in addition thereto locking means on the telescoping segments for locking them in any assigned position.

5. The musical instrument of claim 4 having in addition thereto guide means on at least one of the telescoping segments for the elongated flexible member.

6. The musical instrument of claim 5 having in addition thereto locking means on the guide means for holding the elongated flexible member in any assigned position.

7. The musical instrument of claim 6 in which the guide means is slidably mounted on the telescoping segments.

8. The musical instrument of claim 7 in which the connecting means attaching the flat flexible member to the elongated member is adjustable.

* * * * *